US009598145B1

(12) United States Patent
DeChant et al.

(10) Patent No.: US 9,598,145 B1
(45) Date of Patent: Mar. 21, 2017

(54) INFLATABLE DRIFT BOAT

(71) Applicants: Richard DeChant, Kernville, CA (US); Gregory Yeager, Lakewood, CO (US)

(72) Inventors: Richard DeChant, Kernville, CA (US); Gregory Yeager, Lakewood, CO (US)

( * ) Notice: Subject to any disclaimer, the term of this patent is extended or adjusted under 35 U.S.C. 154(b) by 0 days.

(21) Appl. No.: 15/097,927

(22) Filed: Apr. 13, 2016

(51) Int. Cl.
*B63B 7/08* (2006.01)
*B63H 16/06* (2006.01)
*B63B 29/04* (2006.01)

(52) U.S. Cl.
CPC ..... *B63B 7/085* (2013.01); *B63B 7/08* (2013.01); *B63B 29/04* (2013.01); *B63H 16/06* (2013.01); *B63B 2029/043* (2013.01)

(58) Field of Classification Search
CPC B63B 35/58; B63B 35/71; B63B 7/08; B63B 7/082; B63H 16/06
USPC .... 114/345; 441/40; 440/106, 107, 108, 109
See application file for complete search history.

(56) References Cited

U.S. PATENT DOCUMENTS

| | | | | |
|---|---|---|---|---|
| 4,309,173 A * | 1/1982 | Leber | B63H 16/06 | 440/106 |
| 5,868,095 A * | 2/1999 | Zeromski | B63B 7/085 | 114/345 |
| 8,800,466 B1 * | 8/2014 | Shimozono | B63B 1/22 | 114/345 |
| 2003/0008574 A1 * | 1/2003 | Jougla | B63H 16/06 | 440/106 |
| 2011/0036284 A1 * | 2/2011 | Chon | B63B 3/38 | 114/345 |

* cited by examiner

*Primary Examiner* — Lars A Olson
(74) *Attorney, Agent, or Firm* — James M. Duncan, Esq.; Klein DeNatale Goldner

(57) ABSTRACT

An inflatable hull fabricated from a drop stitch material is configurable to either a dory or drift boat. The inflatable hull has oarlocks which may be placed within urethane mounts, which are glued or thermally bonded to the fabric making up the gunnels of the boat, thereby eliminating any need for a stiff frame for attachment of oars to the craft. The inflatable hull may have internal structures, such as seats, thigh braces and panels, which are also fabricated from drop stitch material as an integral unit with the hull. Alternatively, the seats, thigh braces and panels may be fabricated as attachable and detachable components which allow a single hull to be utilized either as a dory or a drift boat.

15 Claims, 6 Drawing Sheets

INFLATABLE DRIFT BOAT

RELATED APPLICATIONS

There are no related applications currently pending.

BACKGROUND OF THE INVENTION

The presently disclosed invention generally relates to recreational boating. More particularly, the presently disclosed invention relates to drift boats and dories.

Drift boats and dories were originally developed as work boats for fisherman who typically encountered severe conditions. The vessels typically have a wide, flat bottom, flared sides, a narrow and flat bow and either a pointed stern—for navigating rapids better—or a transom which serves as a motor mount. The bottom of the boats may have an arc from bow to stern, known as the "rocker", which allows the boat to spin about its center for ease in maneuvering in rapids. The flat bottom provides for a low draft, so the vessels may be utilized in shallow water. Because the boats are often propelled by oars, with the rower facing downstream, the bow is narrow to throw the waves to the side. The vessels are amazingly maneuverable and seaworthy Dories are designed to run whitewater, so the vessels are designed to be watertight. For example, storage compartments in the bow and stern have watertight hatches which provide internal airspace for additional buoyancy. Some dories are self-righting. On the other hand, drift boats, as the name implies, are typically utilized for drifting on calmer waters and for fishing. The conventional drift boat is not typically made to run whitewater. Drift boats typically do not have large storage compartments other than minimal airtight storage. Drift boats are typically shell and open space, allowing fishermen in the boat to move easily about within the boat with their equipment. However, the hulls of both vessels are substantially the same. Because the present invention primarily discloses a unique configuration a hull which is common to dories and drift boats, unless specifically stated otherwise, the term "drift boat" shall be understood below to include both dories and drift boats as described above.

Drift boats were originally built from cedar planks, which are resistant to warping and rotting. The early drift boats, like all flat-bottom boats, had square chines (where the bottom of the dory and its sides meet). Most modern-day drifts boats, however, employ the use of fiberglass or aluminium. However, each of these materials have drawbacks.

Regarding fiberglass, the outer protective coating of a fiberglass drift boat, the gel coat, can become damaged from impacts with rocks, prolonged dragging of the boat on dry ground during portages or remote launches and even debris from the road kicked up during transit. If left un-repaired, these exposed areas can allow water to permeate the internal layering of fiberglass and lead to rot. Though relatively easy to fix, some people simply don't want the hassle, cost or time commitment of continual maintenance. Even storing a fiberglass drift boat outdoors without a cover can lead to problems as some gel coats can be cracked, discolored or deteriorated by UV light, temperature extremes and even exposure to water.

There are also a few notable drawbacks to aluminum drift boats. The boats can be very loud. Dropping objects on the floor of the boat or banging the boat into a boulder will let every fish and fisherman on the drift know the boat is coming. Aluminum boats also tend to 'stick' to rocks and require a hull treatment of epoxy to ease sliding off submerged rocks and through shallow tailouts. The boat material is noticeably impacted by the temperature. The boats feel very cold in the winter and very hot when exposed to the summer sun.

All known drift boats are fabricated from rigid materials which must be transported on trailers or the like and which consume a significant space when stored. A drift boat fabricated from materials not subject to the disadvantages discussed above would be highly desirable. In addition, because the hulls of drift boats and dories are substantially the same, it would be desirable to have a single vessel which could provide both white water and calm water service. However, the interiors of the vessels have significant differences because of the need to provide watertight components for dories utilized in white water service which are not required for the calm service typically enjoyed by drift boats. An embodiment of a hull configuration which allows for insertion or removal of structural components to convert a single hull into either a drift boat or dory would be highly desirable as well.

Alternatively, an embodiment of hull configuration in which all internal structures of the vessel such as seats, storage compartments, brace members, etc., are configured as a single unit may be desirable to simplify storage, transportation and inflaction.

SUMMARY OF THE INVENTION

Embodiments of the present invention provide solutions to the problems for the known drift boats discussed above. Embodiment of the present invention comprise an inflatable drift boat which maintains the characteristic structural features of a drift boat, i.e., a wide, flat bottom, flared sides, a narrow and flat bow, a pointed stern, and an arc, or rocker, which extends from bow to stern. Embodiments of the present invention are fabricated from a drop stitch material which may be inflated and provide great rigidity, without the need for a frame. This feature of the invention provides easy transportation and storage. The fabrication process involves connecting two layers of a base material, such as a polyester fabric, with thousands of lengths of polyester thread or wires to form cells in which the two layers are held in parallel position by the lengths of thread or wire. The base material of each cell is coated with an air-tight coating to provide for an airtight seal when cells are connected together form the desired structures without the need for separate frames. When pressurized, the resulting structure has a strong and hard surface.

Embodiments of the present invention further comprise oarlocks having an angle ranging from 12 to 15 degrees with an oar set at a right angle within the oar lock. The oarlocks may be set within urethane mounts—referred to as oarlock bases—which are, in turn, glued or thermally bonded to the fabric making up the gunnels of the boat. The oarlock bases are sufficiently wide so that as the oars are worked within the oarlocks, the drop stitch on either side of the base does not flex or distort. Bronze or nylon bushings may be disposed within the oarlocks for retaining the oars.

As opposed to other craft in which the oarlocks are mounted to a frame, in the disclosed embodiments of the present invention, the urethane oarlock mounts wrap around the top of the gunnel which helps protect the drop stitch fabric from wear should the oar touch the boat fabric. The urethane mount is glued directly to the fabric. In white water service, it is not uncommon for boats to turn upside down and crash into rocks. In such situations, metal frame parts utilized to attach oar locks can be damaged beyond repair, stranding the passengers of the craft. However, the urethane oarlock mounts of the present invention may be flexed, bent, or folded around rocks and return to the original configuration and remain suitable for use. The inventors herein have found that urethane mounts having a hardness of approximately 90 durometer provides a suitable compromise—too soft a mount will flex during rowing, but too hard of a mount would not easily conform to the shape of the boat and be harder to glue.

It would also be advantageous, because of the similarity of the hulls, to be able to easily convert a drift boat to a dory and vice-versa. Because all or most of the structural components of the presently described water craft are inflatable, and therefore relatively light and easy to transport, the internal structures which form the watertight compartments of a dory may be installed into a hull previously used as a drift boat to convert the vessel into a dory for white water service. The vessel may be easily converted back to a drift boat by removal of the internal structures.

Alternatively, an embodiment of the present invention may comprise a single structure comprising the hull and all internal structures, such as seats, braces, enclosable storage, etc., where the single structure may be stored and transported in a single piece. The single structure will comprise a plurality of separate inflatable chambers which are filled with air when it is desired to utilize the vessel.

Embodiments of the present invention provide an easily transportable and stowable drift boat. Simply add air, oars, and a bow line the boat is ready to go. The inventors herein have found that a completed boat can be inflated and rigged in less than ten minutes by a single person.

DETAILED DESCRIPTION OF THE INVENTION

Figure 1:
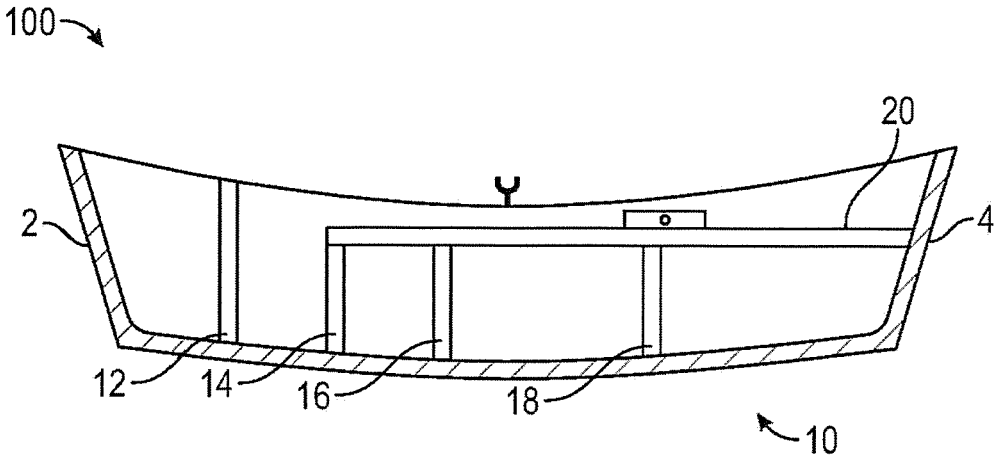
FIG. 1 depicts a sectional side view of an embodiment of an inflatable drift boat (dory) for whiter water applications fabricated in accord with the disclosures herein.

Referring now to the figures, FIG. 1 shows a sectioned side view of an inflatable dory 100 fabricated from a drop stitch material. The dory 100 has a unitary hull 10 having a pointed bow 2, a pointed stern 4, a port side 6, a starboard side 8, and a flat bottom which extends from the bow 2 to the stern 4. It is to be noted from the figures that the bottom has an arc or "rocker" which extends from bow 2 to stern 4. Dory 100 is suitable for use in white water service because of the various water tight storage compartments provided by walls 12, 14, 16 and 18, which are closed by deck members 20.

Figure 11:
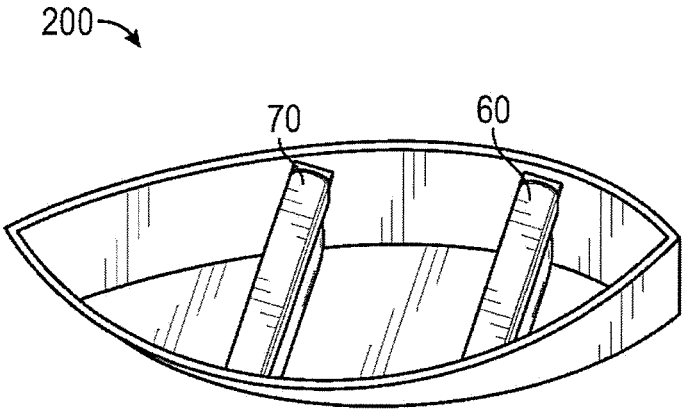
FIG. 11 depicts a plan view of an embodiment of an inflatable drift boat, used for calm water service, which may be formed either as a single structure or formed as separate components, such as a hull structure which is inflated and then completed by the insertion of the inflatable seat members of FIGS. 8 and 9 into a hull.
Figure 12:
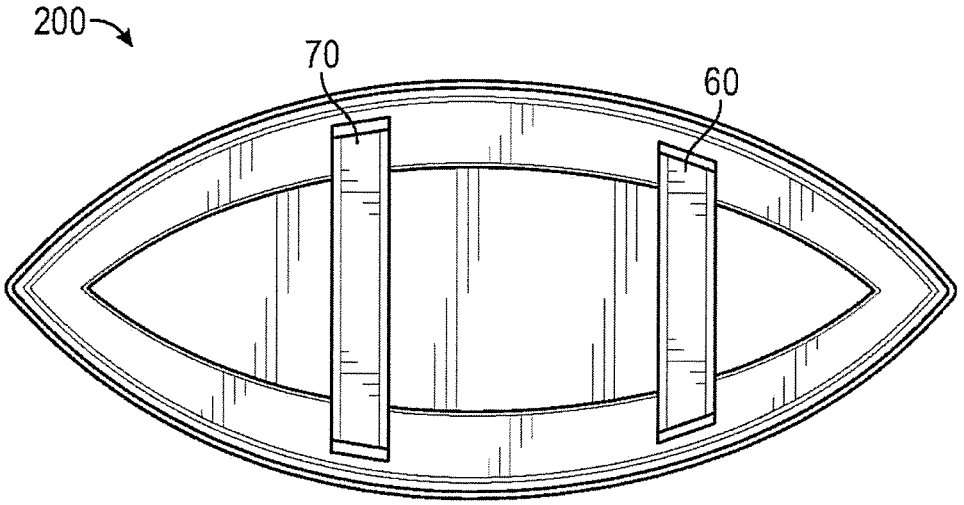
FIG. 12 depicts a top view of the embodiment of FIG. 11.
Figure 13:
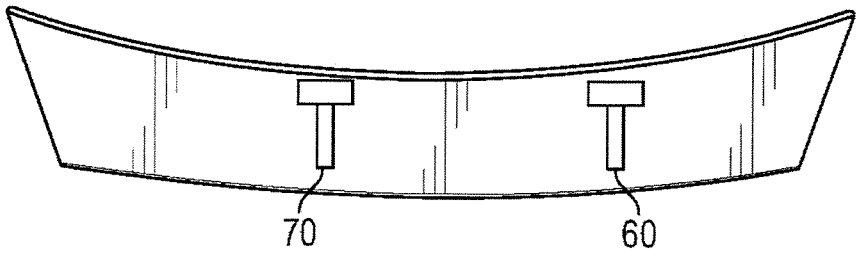
FIG. 13 depicts a sectioned view of the embodiment depicted in FIG. 11.

The structural members forming the water tight storage compartments may either be fabricated as a solitary matrix along with the hull, where the different panels of drop stitch material are joined by glue, thermal bonding, or other joining methods known in the art. Alternatively, the internal structures may be fabricated separately from the hull as detachable units, which are light and easily removable, with the structural members secured in place by a variety of fasting devices such as hook and loop fasteners, straps and plastic buckles, and other known light weight devices having no sharp edges. Thus, the inflatable dory 100 depicted in FIGS. 1 and 3 may be easily transformed into the inflatable drift boat 200 depicted in FIGS. 11-13 by removal of the internal structural members 12, 14, 16 and 18 and insertion of the seat members 60 and 70 discussed below.

Figure 2A:
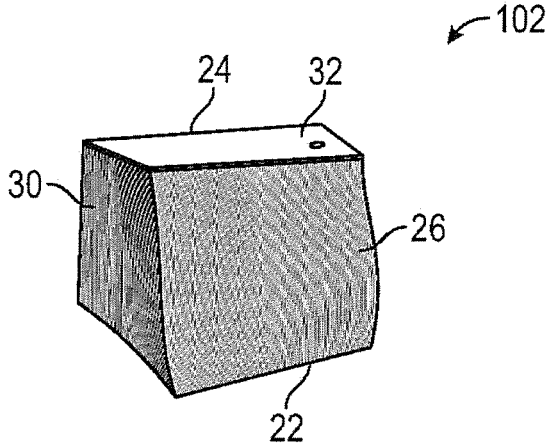
FIG. 2A shows a sectioned view of a portion of a drop stitch cell utilized to fabricate the components of the inflatable drift boat.
Figure 2B:
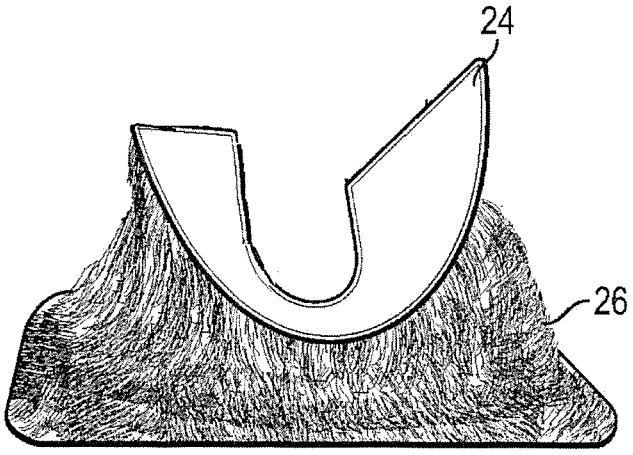
FIG. 2B shows a small portion of a drop stitch material.

FIGS. 2A and 2B show a close up sectioned view of a portion of a drop stitch cell 102 a plurality of which is utilized to fabricate the various components of the inflatable drift boat. The drop stitch cell 102 comprises a first layer 22 and a second layer 24. The first layer 22 and the second layer 24 are attached together by a plurality of spaced-apart connecting members 26, leaving void space for inflation. The first layer 22 and the second layer 24 are typically fabricated from polyester fabric. The plurality of connecting members 26 are typically lengths of thread or wire. First layer 22 and second layer 24 are treated with an air tight coating 30 so that, upon inflation through a valve 32, the drop stitch cell 102 retains air. When inflated, each drop stitch cell utilized to form the structural components of the inflatable drift boat 100 will have a strong and hard surface.

Figure 4:
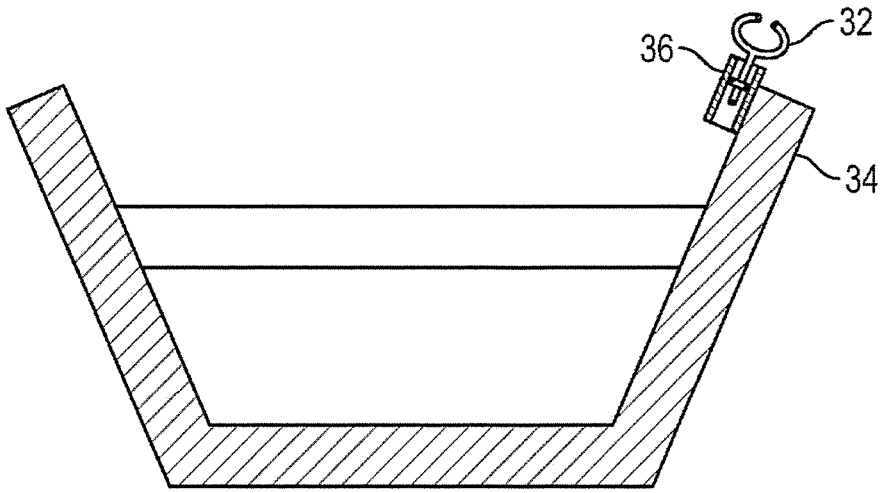
FIG. 4 depicts a sectional view of an inflatable drift boat along its width showing a detailed view of an oarlock attached on a gunnel.
Figure 5:
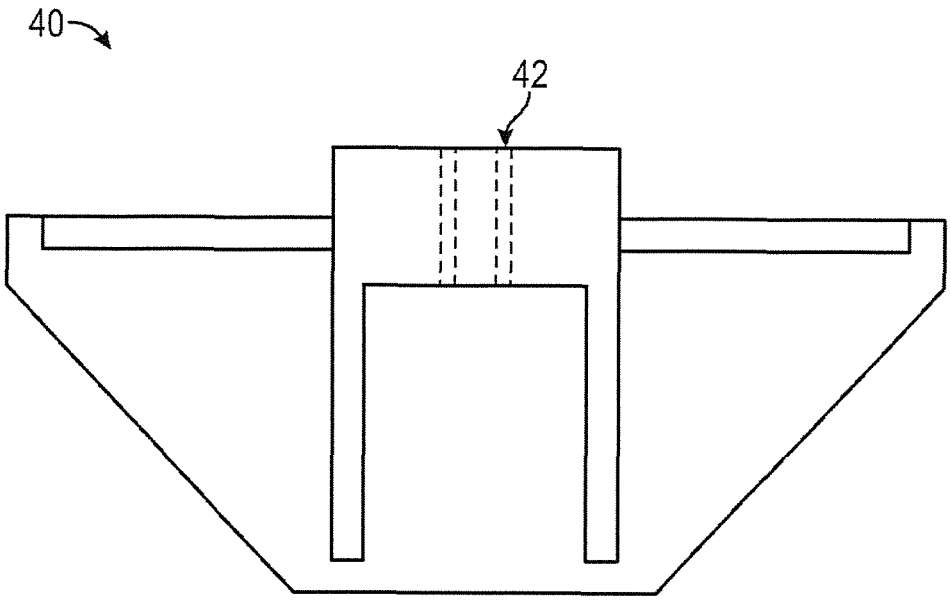
FIG. 5 depicts a detailed elevational view of the oarlock depicted in FIG. 4, viewed looking toward the gunnel of the drift boat.
Figure 6:
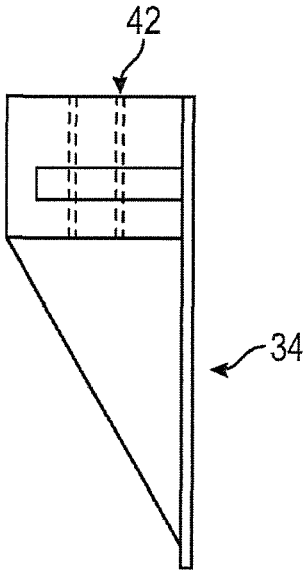
FIG. 6 depicts a detailed side view of the oarlock depicted in FIG. 4.
Figure 7:
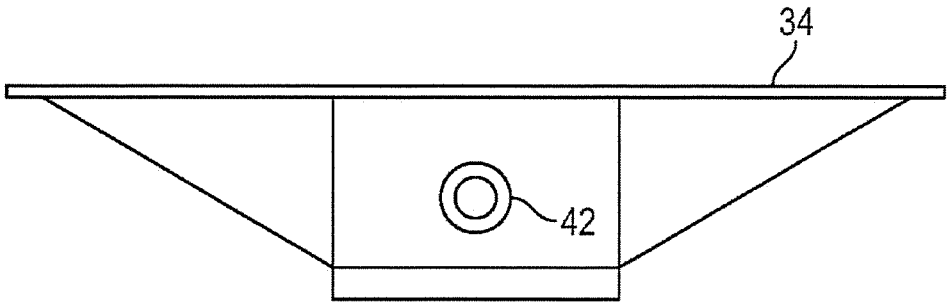
FIG. 7 depicts a top view of the oarlock depicted in FIG. 4.

FIG. 4 depicts a sectional view of an inflatable drift boat 100 along its width showing how an oarlock 32 may be attached to a gunnel 34 of port side 6 or starboard side 8. Oarlock 32 is set within a urethane base 34 which is glued to the fabric which makes up gunnel 34. The urethane base 36 wraps around the fabric forming gunnel 34 following the natural curve of the boat. The urethane base 36 forms an additional layer of protection from the oar wear against the top of the tunnel. FIGS. 5-7 show a detailed view of how the urethane base 36 provides a reinforcement structure 40 which is utilized to support oarlock 32. A cast-in bronze bushing 42 is set within the reinforcement structure 40, where oarlock 32 sets within the bronze bushing. The reinforcement structure 40 is sufficiently wide so that the drop stitch forming the cell adjacent to the oarlock 32 does not flex or distort. The oar locks are set at an angle of approximately 12 to 15 degrees, such that the hole pin is at a right angle to the boat when rowing the boat.

It is to be appreciated that the utilization of the urethane base 34 in the manner described above eliminates the need for a stiff frame otherwise utilized with drift boats, where the oarlocks are set on the tops of the gunnels. The inventors herein have found that a urethane base having a hardness of 90 durometer provides sufficient stiffness to prevent flexing of the surrounding drop stitch forming the cell adjacent to the oarlock 32, but soft enough that the material of the urethane base will conform to the shape of gunnel 34.

Figure 3:
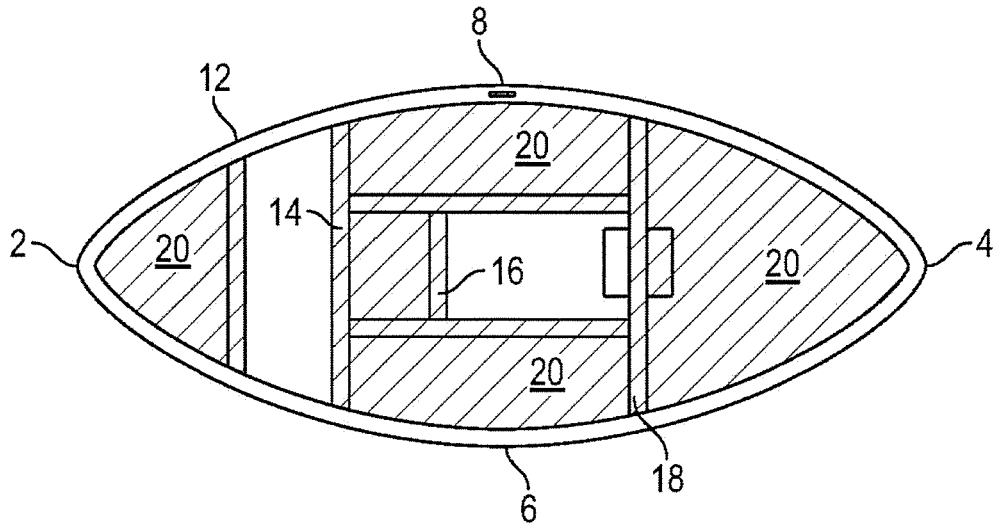
FIG. 3 depicts a top view of the embodiment of the inflatable drift boat shown in FIG. 1.
Figure 8:
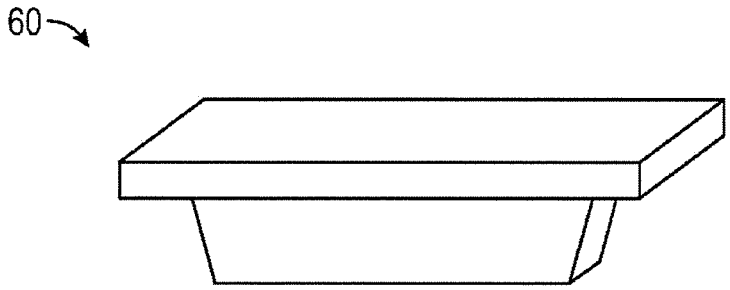
FIG. 8 depicts a perspective view of an inflatable seat member manufactured from a drop stitch process which may be utilized in embodiments of the disclosed inflatable drift boat.
Figure 9:
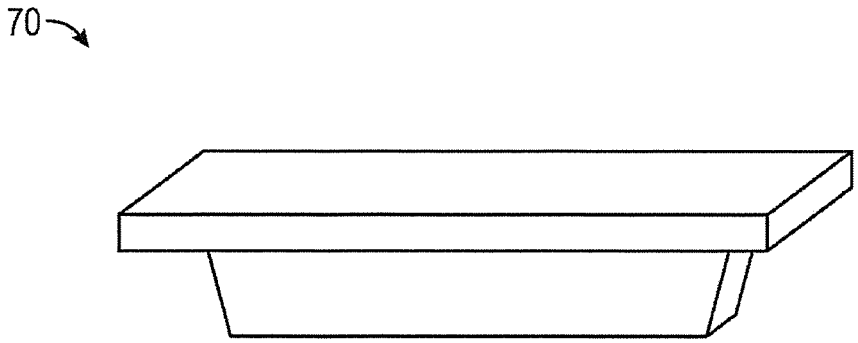
FIG. 9 depicts a perspective view of a second inflatable seat member manufactured from a drop stitch process which may be utilized in embodiments of the disclosed inflatable drift boat.
Figure 10:
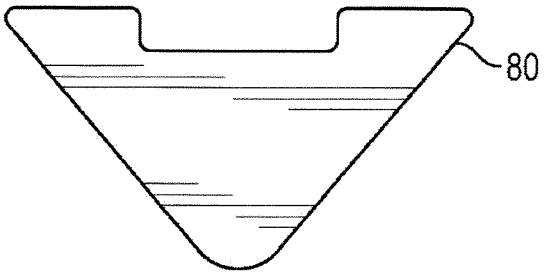
FIG. 10 depicts a front view of an inflatable thigh brace member manufactured from a drop stitch process which may be utilized in embodiments of the disclosed inflatable drift boat.

FIGS. 8-10 show a variety of inflatable structural members which may be utilized in transforming the same basic hull from a dory 100 as shown in FIGS. 1 and 3 to a drift boat 200 as shown in FIGS. 11-14. FIG. 8 depicts an inflatable front seat member 60 manufactured from a drop stitch process which may be utilized in embodiments of the disclosed inflatable drift boat 200. FIG. 9 depicts an inflatable rear seat member 70 which may likewise be utilized in embodiments of the disclosed inflatable drift boat 200. FIG. 10 shows an inflatable thigh brace member 80 manufactured from a drop stitch process which may be utilized in embodiments of the disclosed inflatable drift boat 200 shown in FIGS. 11-14. As with the structural members utilized in forming the dory 100, the structural members utilized in forming drift boat 200 may be secured by as hook and loop fasteners, straps and plastic buckles, and other known light weight devices having no sharp edges.

Figure 14:
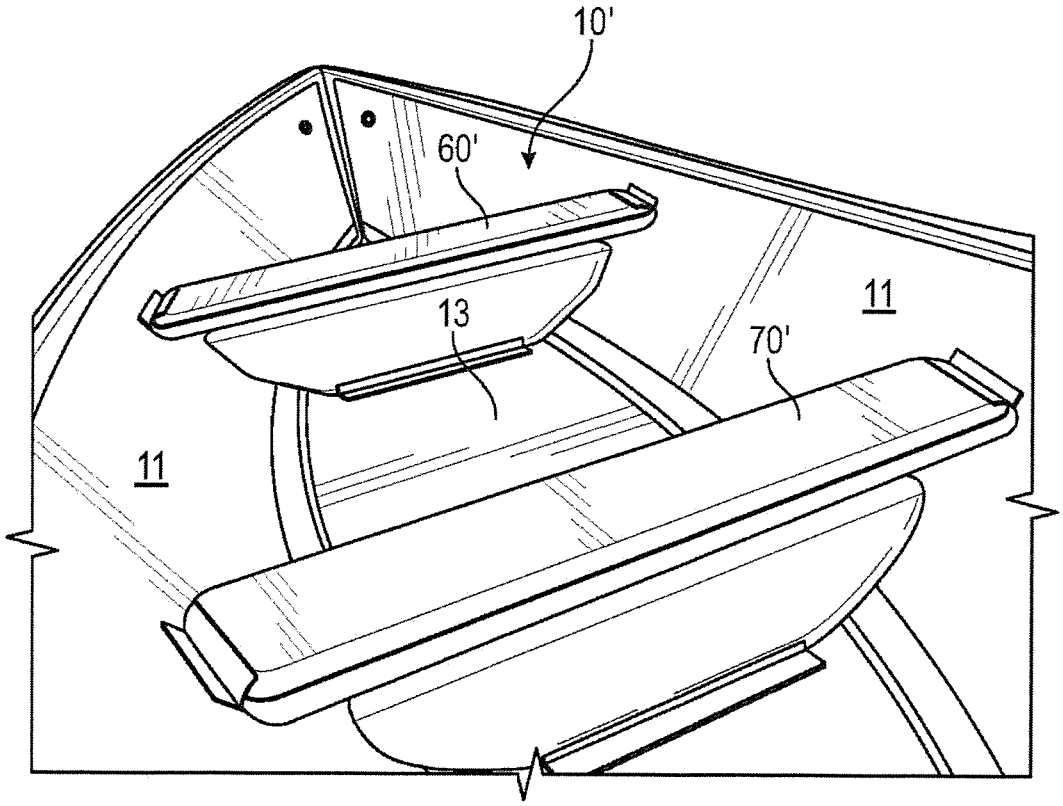
FIG. 14 shows a perspective view of an embodiment of an inflatable drift boat of unitary construction, where the seats and hull are configured as a single structure.

As shown in FIG. 14, unitary hull 10 will typically be configured to have three main air chambers in each of sides 11 and floor 13. The embodiment shown in FIG. 14 is a drift boat in which the hull 10' is fabricated with seats 60' and 70' as integral units.

Having thus described the preferred embodiment of the invention, what is claimed as new and desired to be protected by Letters Patent includes the following:

The invention claimed is:

1. A water craft comprising:

an inflatable hull comprising a pointed bow, a stern, a port side and a starboard side and a bottom extending between the port side to the starboard side and from the bow to the stern, the bottom flat and having an arc extending from the pointed bow to the stern;

wherein the hull is fabricated of a plurality of cells, wherein the plurality of cells comprise a drop stitch material, the drop stitch material comprising a first layer and a second layer wherein the first layer and the second layer are attached together by a plurality of spaced-apart connecting members to form the plurality of cells;

an air-tight coating applied to the first layer and the second layer;

wherein a vessel interior is defined between a port side gunnel and a starboard side gunnel;

an oarlock disposed within an oarlock base set within the port side gunnel or the starboard side gunnel; and a cast-in bronze bushing for disposition of the oarlock.

2. The water craft of claim 1 wherein the inflatable hull comprises a seat member fabricated from the drop stitch material.

3. The water craft of claim 2 wherein the seat member is fabricated as an integral structure with the inflatable hull.

4. The water craft of claim 2 wherein the seat member is selectively attachable and detachable from the inflatable hull.

5. The water craft of claim 1 further comprising a dory having a removable inflatable deck member fabricated from the drop stitch material.

6. The water craft of claim 1 further comprising a dory having an integral deck member fabricated from the drop stitch material.

7. The water craft of claim 1 further comprising a reinforcement structure into which the oarlock base is disposed, the reinforcement structure comprising a urethane base.

8. The water craft of claim 7 wherein the urethane base has a hardness of 90 durometer.

9. A water craft comprising:

an inflatable hull comprising a pointed bow, a stern, a port side and a starboard side and a bottom extending between the port side to the starboard side and from the bow to the stern, the bottom flat and having an arc extending from the pointed bow to the stern;

wherein the hull is fabricated of a plurality of cells, wherein the plurality of cells comprise a drop stitch material, the drop stitch material comprising a first layer and a second layer wherein the first layer and the second layer are attached together by a plurality of spaced-apart connecting members to form the plurality of cells;

an air-tight coating applied to the first layer and the second layer;

wherein a vessel interior is defined between a port side gunnel and a starboard side gunnel;

a seat member disposed within the vessel interior, the seat member fabricated from a drop stitch material;

an oarlock disposed within an oarlock base set within the port side gunnel or the starboard side gunnel; and a cast-in bronze bushing for disposition of the oarlock.

10. The water craft of claim 9 wherein the seat member is selectively attachable and detachable from the inflatable hull.

11. The water craft of claim 9 wherein the seat member is fabricated as an integral structure with the inflatable hull.

12. The water craft of claim 9 further comprising a dory having a removable inflatable deck member fabricated from the drop stitch material.

13. The water craft of claim 1 further comprising a dory having an integral deck member fabricated from the drop stitch material.

14. The water craft of claim 9 further comprising a reinforcement structure into which the oarlock base is disposed, the reinforcement structure comprising a urethane base.

15. The water craft of claim 14 wherein the urethane base has a hardness of 90 durometer.

* * * * *